US008511762B2

(12) United States Patent
Stegerwald

(10) Patent No.: US 8,511,762 B2
(45) Date of Patent: Aug. 20, 2013

(54) REMOVABLE KICK PANEL FOR A HOUSEHOLD APPLIANCE

(75) Inventor: Gerhard Stegerwald, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 324 days.

(21) Appl. No.: 12/722,864

(22) Filed: Mar. 12, 2010

(65) Prior Publication Data

US 2011/0221313 A1 Sep. 15, 2011

(51) Int. Cl.
*A47B 77/06* (2006.01)

(52) U.S. Cl.
USPC ..... 312/228; 312/265.6

(58) Field of Classification Search
USPC ..... 312/109, 204, 228, 265.6, 311, 236, 312/265.5, 279; 160/369, 371, 40, 41; 49/501
See application file for complete search history.

(56) References Cited

U.S. PATENT DOCUMENTS

| | | | | |
|---|---|---|---|---|
| 1,051,321 | A * | 1/1913 | Fox | 292/251 |
| 2,200,158 | A * | 5/1940 | Clarke | 403/404 |
| 5,964,513 | A * | 10/1999 | Korinsky et al. | 312/223.2 |
| 6,191,363 | B1 * | 2/2001 | Samuels | 174/68.3 |
| 6,460,949 | B2 | 10/2002 | Jung | |
| 6,736,470 | B2 * | 5/2004 | Manke et al. | 312/228 |
| 6,997,530 | B2 * | 2/2006 | Avendano et al. | 312/401 |
| 2006/0254854 | A1 * | 11/2006 | Herrera et al. | 181/200 |
| 2007/0180868 | A1 | 8/2007 | Hur | |
| 2008/0072935 | A1 * | 3/2008 | Han et al. | 134/104.2 |
| 2009/0033185 | A1 | 2/2009 | Park et al. | |
| 2009/0096331 | A1 | 4/2009 | Park et al. | |
| 2009/0153004 | A1 * | 6/2009 | Han et al. | 312/228 |
| 2009/0211307 | A1 | 8/2009 | Park | |
| 2009/0223256 | A1 | 9/2009 | Kim et al. | |

FOREIGN PATENT DOCUMENTS

| | | | |
|---|---|---|---|
| DE | 4240888 | * | 6/1994 |
| WO | WO2007-073105 | * | 6/2007 |
| WO | WO2008-138227 | * | 11/2008 |

* cited by examiner

*Primary Examiner* — Darnell Jayne
*Assistant Examiner* — Matthew Ing
(74) *Attorney, Agent, or Firm* — James E. Howard; Andre Pallapies

(57) ABSTRACT

A kick panel for a household appliance, wherein the household appliance includes a housing body and a front panel defining a front of the housing body, the front panel including a front wall and a first side wall adjacent to a first end of the front wall of the front panel, the first side wall of the front panel including a cut-out. The kick panel includes a front wall and a first side wall adjacent to a first end of the front wall of the kick panel, wherein an inner concealed surface of the first side wall of the kick panel includes a catch device extending therefrom for engaging the cut-out of the front panel and securing the kick panel to the front panel, and wherein the kick panel conceals the catch device from view when viewed from a front of the household appliance.

41 Claims, 17 Drawing Sheets

REMOVABLE KICK PANEL FOR A HOUSEHOLD APPLIANCE

FIELD OF THE INVENTION

The present invention is directed to a household appliance, and more particularly, to a household appliance including a removable kick panel, and more particularly, to a household appliance including a removable kick panel having a concealed catch and no visible fixation areas.

BACKGROUND OF THE INVENTION

A household appliance, such as a front-loading clothes washer or dryer, includes a housing having a door that provides access to a washing unit or drying unit in the interior of the appliance housing. For example, in a washer, the washing unit includes a tub having a cylindrical washing drum rotatably mounted inside the tub. In operation, clothes or laundry are inserted into the washer through the door and placed in the rotating washing drum inside the tub. The household appliance wets the laundry to be washed with washing liquid and mechanically moves the laundry to release contaminants from the laundry. A drive system rotates the washing drum inside the tub about an axis of the drum. A pump is coupled to a drain on the bottom of the tub for removing washing liquid from the tub.

In operation, small laundry items (e.g., baby socks, mittens, fluff, etc.) can get sucked into the pump during the drain cycle, thereby causing a blockage in the pump. In some conventional appliances, the user is not provided with any access to the pump, and therefore, a service technician must be called to clear the blockage in the pump, which increases operating costs to the user. It is desirable to provide the user with access to the pump such that the user can clear the pump blockage themselves, thereby reducing or avoiding service costs for common pump blockages.

In some conventional household appliances, the user access to the pump is provided, for example, by incorporating a small access door at the front of the washer, or by providing a kick panel coupled to the front panel of the appliance that can be removed to access the pump. Product Safety Certification Organizations, such as Underwriters Laboratories Inc. (UL), mandate that the user be prevented from touching any electrically live parts or rotating parts without the use of a tool. In order to comply with these requirements, many conventional appliances use secondary fixation devices for securing the access door or the kick panel to the front panel of the appliance. These secondary fixation devices, which commonly include threaded fasteners such as screws, bolts, etc., require the use of a tool (e.g., a screwdriver, hex wrench, socket, etc.) to remove the access door or kick panel.

In the conventional appliances having a small access door in the front panel, there is a problem in that the access door affects the aesthetic appearance of the appliance when viewed from the front, which generally is undesirable to the user. Moreover, the access door commonly is fixed using one or more threaded fasteners, such as screws, which are visible from the front and hence have a negative effect on the aesthetic appearance of the appliance.

In other conventional appliances, a kick panel may be provided. The kick panel can be configured to be removed to access the pump, parts, etc. Such conventional kick panels commonly are rigid metal kick panels secured by a plurality of threaded fasteners that must be removed and then reinstalled by the user after accessing the pump. In these devices, there commonly is a problem that the fixation devices, which commonly include threaded fasteners such as screws, bolts, etc., for securing the kick panel to the front panel of the appliance, are visible from the front of the appliance. This is particularly the case when the appliance is arranged in a stacked configuration and the location of the fixation devices is closer to the chest height or eye level of the user. Conventional designs have attempted to hide these fixation devices from being visible to the user, for example, by locating the screws under the lower edge of the kick panel. However, the known conventional solutions for concealing or hiding the fixation devices from view generally reduce or limit the accessibility to the fixation devices by the user, which results in additional time, effort, and difficulty to remove the kick panel. In many cases, it is necessary to tilt the household appliance backward in order to access the fixation devices. There is a problem in that it may not be possible for a user to tilt the appliance, for example, in built-in configurations, stacked configurations, etc. It also may be difficult for some users to provide enough force to tilt the weight of the appliance. These conventional solutions may lead to an increased risk of tipping of the appliance, damage to the appliance or adjacent appliances/fixtures, and/or injury to the user.

In some conventional devices, the kick panel may include a step portion formed, for example, at the lower front surface to provide access to the fixation devices, for example, using a screwdriver, hex wrench, socket, etc. without tilting. As a result, both the step portion and the screws are visible from the front of the appliance, each of which affects the aesthetic appearance of the appliance to the user.

SUMMARY OF THE INVENTION

These problems and others are addressed by the present invention, exemplary embodiments of which provide a removable kick panel for a household appliance, such as a washer or dryer, having catch means that are concealed from view from the front of the household appliance, thereby improving the aesthetic appearance of the household appliance while providing user access, for example, to the pump. The exemplary embodiments provide a removable kick panel that is easily accessible for various appliance configurations, such as stacked, side-by-side, and built-in configurations, and that is easily removed and installed by a user with minimal or no tools, and without moving or tilting the appliance. Moreover, the exemplary embodiments provide a removable kick panel that does not require secondary fixation devices, such as threaded fasteners, for securing the kick panel to the front panel of the appliance.

An exemplary embodiment of the kick panel can include a concealed catch at one or both ends of the kick panel for removably coupling the kick panel to the front panel of the household appliance.

In a preferred exemplary embodiment, the kick panel, or at least the sidewalls thereof, can be flexible such that the sidewalls of the kick panel can be flexed, bent, or bowed away from the sidewalls of the front panel, thereby enabling the kick panel to removably snap over the metal front panel of the appliance.

The concealed catch of the kick panel can include, for example, an integrated catch formed on an inner surface of the sidewalls of the kick panel such that the front wall of the kick panel has no visible fixation area when viewed from the front of the appliance, thereby improving the aesthetic appearance of the kick panel to the user. Each catch can be configured to match up with a cut-out portion or retaining slot formed in a sidewall of the underlying metal front panel of the appliance.

In a preferred exemplary embodiment, the catch can be formed in the shape of a wedge having a cam surface projecting from the inner surface of the sidewall for engaging the cut-out portion formed in the sidewall of the underlying metal front panel of the appliance. The hook is not limited to a wedge and can include other suitable shapes, such as a projection, hook, tab, or the like that can engage the cut-out portion in the front panel when the kick panel is snapped over the front panel and that can be disengaged from the cut-out portion by flexing, bowing, or bending the sidewalls of the kick panel away from the sidewalls of the front panel.

In an exemplary embodiment, the kick panel includes two snap hook features, one at each sidewall of the kick panel, that snap into cut-outs formed in each sidewall of the metal front panel. In this manner, the present invention does not require secondary fixation methods, like threaded fasteners, screws, etc. In operation, the two snap hook features locate and fixate the kick panel in a vertical direction. The horizontal (e.g., left to right) location and fixation of the kick panel can be achieved by the kick panel having the same or substantially similar inside width as the front panel width over which the kick panel is wrapped or snapped around.

In another embodiment, the inner surface of the front wall of the kick panel can include a plurality of hooks that engage into a plurality of corresponding cut-outs formed in the front wall of the front panel. The engagement of the plurality of hooks into the front cut-outs can secure or pull the kick panel flush against the front wall of the front panel, thereby minimizing or eliminating any rattling between the kick panel and the front panel during operating cycles of the household appliance.

The exemplary embodiments of the present invention provide a kick panel that can be easily removed and reinstalled. For example, in an exemplary embodiment, the kick panel can be installed by aligning the kick panel with the front panel and then pushing the kick panel against the front panel (i.e. toward the household appliance). At this point, the side walls of the kick panel can flex or bow in an outward direction from the sidewalls of the front panel, for example, as a result of the cam surfaces of the catches on each side of the kick panel gliding against the sidewalls of the front panel. The kick panel then can be pushed upwards until the two catches (e.g., snap hook features) snap into the cut-outs in the sidewalls of the front panel. One of ordinary skill in the art will recognize that the size, shape, and orientation of the catches can vary within the spirit and scope of the invention depending on overall appliance design.

In an exemplary embodiment having catches and front hooks, the kick panel similarly can be installed by aligning the front hooks with the corresponding cut-outs in the front panel and then pushing the kick panel against the front panel (i.e. toward the household appliance). At this point, the side walls of the kick panel can flex or bow in an outward direction from the sidewalls of the front panel, for example, as a result of the cam surfaces of the catches on each side of the kick panel gliding against the sidewalls of the front panel. The kick panel then can be pushed upwards until the front hooks engage the front cut-outs in the front panel and the two catches (e.g., snap hook features) snap into the cut-outs in the sidewalls of the front panel. One of ordinary skill in the art will recognize that the size, shape, and orientation of the catches and front hooks can vary within the spirit and scope of the invention depending on overall appliance design.

To remove the kick panel, a screw driver or a custom tool can be wedged between the sidewall of the kick panel and the sidewall of the front panel to flex or bow the sidewall of the kick panel away from the front panel until the hook or catch clears the underlying cut-out portion of the front panel. The kick panel then can be removed easily and effortlessly from the front panel.

An exemplary embodiment of the kick panel can include a cut-out or kick-panel release hole formed in an edge of the sidewall of the kick panel corresponding, for example, to an optimal location for insertion of a screwdriver or custom tool between the sidewall of the kick panel and the sidewall of the front panel. The cut-out or kick-panel release hole can be, for example, a U-shaped cut-out on each side of the kick panel. In this manner, the present invention can guide the user during the insertion of the screw driver or custom tool for removing the kick panel without affecting the aesthetic appearance of the kick panel when viewed from the front.

In operation, a screw driver, a similar wedge tool, or custom wedge tool can be inserted into the U-shaped opening and in between the side wall of the kick panel and the side wall of the front panel of the appliance. The screw driver or similar tool acts as a wedge or cam surface between the side wall of the kick panel and the side wall of the front panel such that the kick panel flexes or bows outward, thereby disengaging the catches (e.g., snap hooks) at each side of the kick panel from the cut-outs in the sidewalls of the front panel. At this point, the user can apply a slight downwards force to the kick panel, thereby resulting in disengagement of the front hooks (if equipped) from the cut-outs in the front wall of the front panel. The kick panel is disassembled at this stage.

In a preferred exemplary embodiment, the present invention provides a custom wedge tool for insertion between the sidewall of the kick panel and the sidewall of the front panel to remove the kick panel. The exemplary custom wedge tool can include a plastic wedge tool having predetermined geometric dimensions, such as length, height, width, and slope of the cam surface, that match the design of the appliance and that provide a predetermined or optimal amount of flex or bowing of the sidewall of the kick panel to release the catches from the cut-outs or retaining slots of the front panel. In this manner, the present invention eliminates guessing and uncertainties by the user as to whether or not the catches, which are not visible to the user, properly are disengaged.

Another exemplary embodiment can include a step formed between the sidewall of the front panel and the sidewall of the kick panel such that the exemplary plastic wedge tool can snap into place when inserted. The wedge can have a predetermined height that is designed to securely disengage the hook when the wedge is fully seated or snapped in place.

In this manner, the present invention provides important advantages by providing a removable kick panel that easily can be removed by a user without having visible fasteners, such as screws, clips, etc., on the front of the appliance. These exemplary embodiments are particularly advantageous for stacked appliances, such as a stacked washer and dryer, in which the kick panel is readily visible to the user. According to the present invention, no visible step from the side of the unit is necessary, and the kick panel can be configured to extend all the way down to, and matched up with, a lower edge of the side panel of the appliance.

In another exemplary embodiment, the kick panel can include an access hole formed in the front of the kick panel at each end through which a screw driver or similar tool can be inserted to act as a wedge between the sidewall of the kick panel and the sidewall of the front panel. In this embodiment, the screw driver or similar tool can be inserted from the front of the appliance. In this manner, the present invention provides important advantages by providing a removable kick panel that easily can be removed by a user without having visible fasteners, such as screws, clips, etc., on the front of the appliance, and with only a small access hole formed on either side of front wall of the kick panel. This embodiment is particularly advantageous for side-by-side or built-in appliance configurations in which the sidewalls of the kick panel are not readily accessible to the user. According to the present invention, no visible step from the side of the unit is necessary, and the kick panel can be configured to extend all the way down to, and matched up with, a lower edge of the side panel of the appliance.

Another exemplary embodiment of the kick panel can include one or more stops formed on the inner surface of the bottom wall of the kick panel. The stops fill the void or space between the bottom wall of the kick panel and the bottom wall of the front panel, thereby limiting the vertical movement of the kick panel with respect to the front panel after assembly. These features are important for minimizing or preventing damage to the catches, front hooks, or kick panel surfaces resulting from forces being applied to the bottom of the appliance, for example, from dropping the appliance, transporting the appliance, etc. These features also aid in the manufacturing process and the customer re-assembly process by providing a defined stopping point for coupling the kick panel to the front panel.

In addition to or as an alternative to the catches, other exemplary embodiments of the kick panel can include one or more angled channels for securing the kick panel to the front panel using threaded fasteners, such as screws, etc. For example, other embodiments can include a plurality of angled channels (e.g., three angled channels) formed in and spaced across the bottom wall of the kick panel for receiving threaded fasteners. The angled channels can guide the threaded fasteners through openings in the bottom wall of the kick panel, through openings formed in bottom wall of the front panel, and into a bottom plate of the appliance, thereby securing the kick panel to the front panel. The angled channels also conceal the threaded fasteners from view from the front of the appliance, while tilting the fasteners to improve access to the ends of the fasteners.

In another exemplary embodiment, the outer surface of the bottom surface of the kick panel can be angled with respect to a bottom edge of the side walls of the appliance. The angle can be other than 90° such that the angled channels and the threaded fasteners therein are more easily accessed by the user without moving or tilting the appliance from its resting position. Preferably, the outer surface is angled such that the threaded fasteners in the channel can be accessed by inserting the screwdriver substantially straight into the channel (e.g., in a plane perpendicular to the front of the appliance).

The exemplary embodiments of the present invention provide a kick panel for a household appliance, such as a washer or dryer, that easily is removable from, and reinstalled on, the front panel of the household appliance by a user without secondary fixation methods (e.g., screws; clips, etc.). The kick panel according the present invention can be provided with minimal or no visible fixation areas (e.g., holes, screw heads, etc.) when the appliance is viewed from the front, thereby providing user access, for example, to the pump or other parts, while minimizing disruptions to the aesthetic appearance of the appliance.

For example, a first exemplary embodiment of the invention comprises a household appliance comprising a housing body; a front panel defining a front of the housing body, the front panel including a front wall and a first side wall adjacent to a first end of the front wall of the front panel, the first side wall of the front panel including a cut-out; and a kick panel removably secured to the front panel, the kick panel including a front wall and a first side wall adjacent to a first end of the front wall of the kick panel, wherein an inner concealed surface of the first side wall of the kick panel includes a catch device extending therefrom and engaging the cut-out of the front panel and securing the kick panel to the front panel, and wherein the kick panel conceals the catch device from view when viewed from a front of the household appliance.

Another exemplary embodiment of the invention comprises a kick panel for a household appliance, wherein the household appliance includes a housing body and a front panel defining a front of the housing body, the front panel including a front wall and a first side wall adjacent to a first end of the front wall of the front panel, the first side wall of the front panel including a cut-out, wherein the kick panel comprises a front wall and a first side wall adjacent to a first end of the front wall of the kick panel, wherein an inner concealed surface of the first side wall of the kick panel includes a catch device extending therefrom for engaging the cut-out of the front panel and securing the kick panel to the front panel, and wherein the kick panel conceals the catch device from view when viewed from a front of the household appliance.

A further exemplary embodiment of the invention comprises a household appliance comprising a housing body; a front panel defining a front of the housing body, the front panel including a front wall and a first side wall adjacent to a first end of the front wall of the front panel, the first side wall of the front panel including a cut-out; and a kick panel removably secured to the front panel, the kick panel including a front wall and a first side wall adjacent to a first end of the front wall of the kick panel, wherein an inner concealed surface of the first side wall of the kick panel includes concealed catch means for engaging the cut-out of the front panel and securing the kick panel to the front panel, and wherein the kick panel conceals the concealed catch means from view when viewed from a front of the household appliance.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
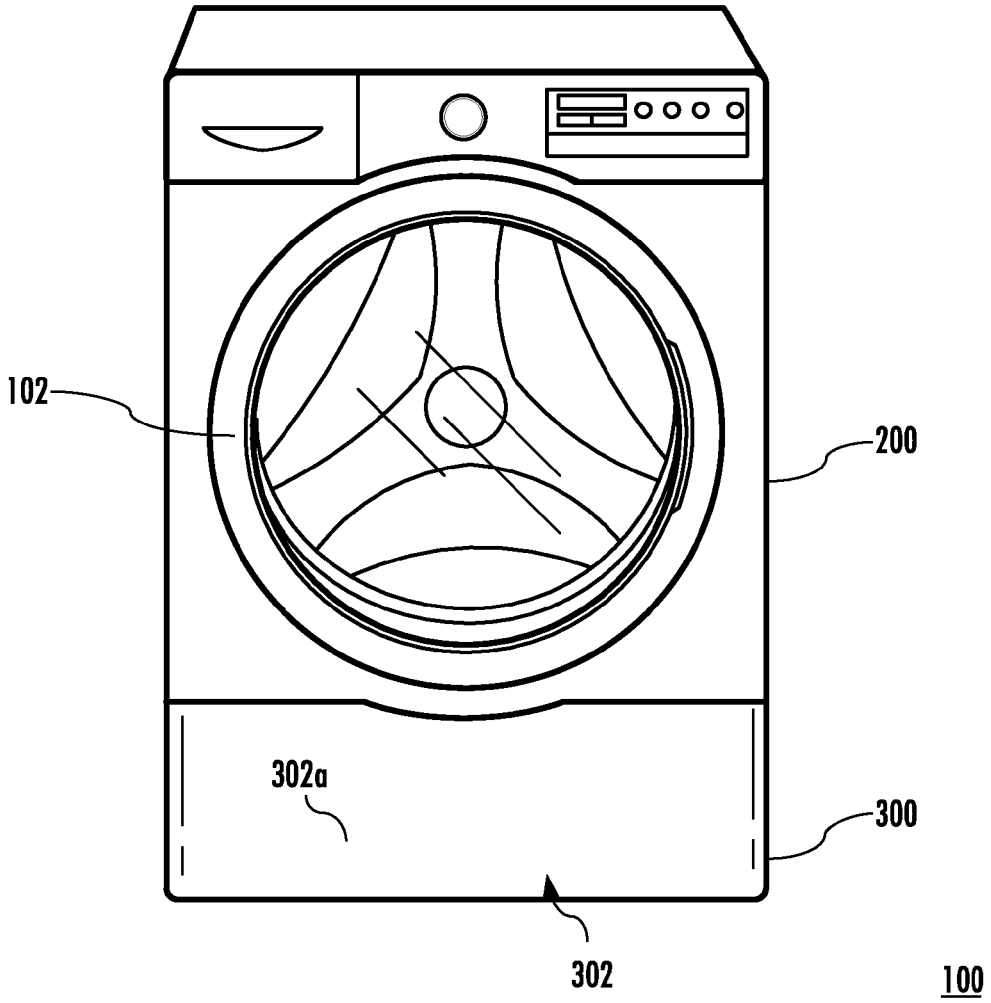
FIG. 1 is a front elevation view of a washer having a kick panel according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-14B illustrate exemplary embodiments of a household appliance.

FIG. 1 illustrates a household appliance, such as a washer 100, having a kick panel 300 according to an embodiment of the invention. The washer 100 includes a housing having a front panel 200 and a door 102 for accessing the interior of the washer. The removable kick panel 300 is removably coupled to the front panel 200. As shown in FIG. 1, the front wall 302 of the removable kick panel 300 has an outer surface 302*a* that is uninterrupted by any visible fixation means. The kick panel 300 can be configured such that there are no visible steps from the side or front of the appliance, and such that the kick panel extends all the way down to, and is matched up with, a lower edge of the side panel of the appliance.

Figure 2:
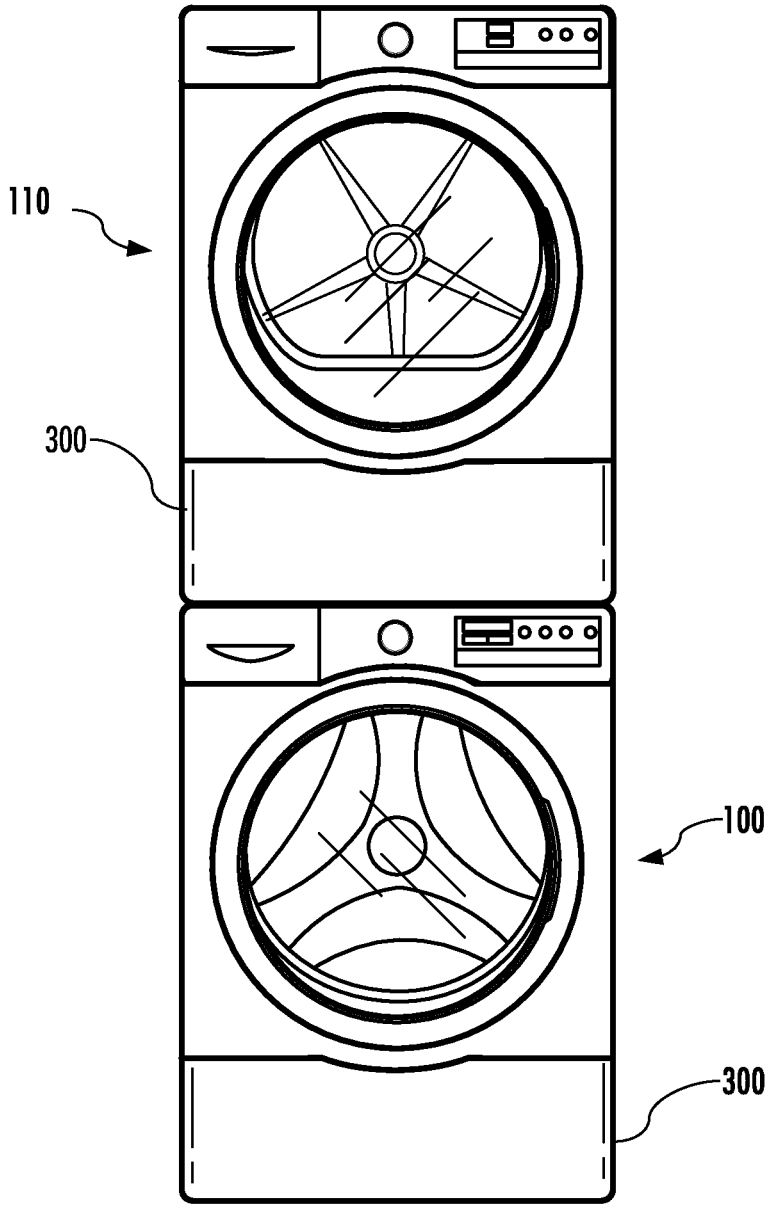
FIG. 2 is a front elevation view of a stacked washer and dryer having kick panels according to an exemplary embodiment of the invention.

FIG. 2 illustrates a stacked arrangement of household appliances, such as a dryer 110 stacked on a washer 100. Each of the washer 100 and dryer 110 can include a kick panel 300 having no visible fixation means. The kick panel 300 can be configured such that there are no visible steps from the side or front of the appliances. In this embodiment, the kick panel 300 extends all the way down to, and is matched up with, a lower edge of the side panel of the appliance. Other arrangements are possible, such a built-in arrangements and side-by-side arrangements, which will be described in greater detail with respect to additional embodiments described in FIG. 10.

Figure 3:
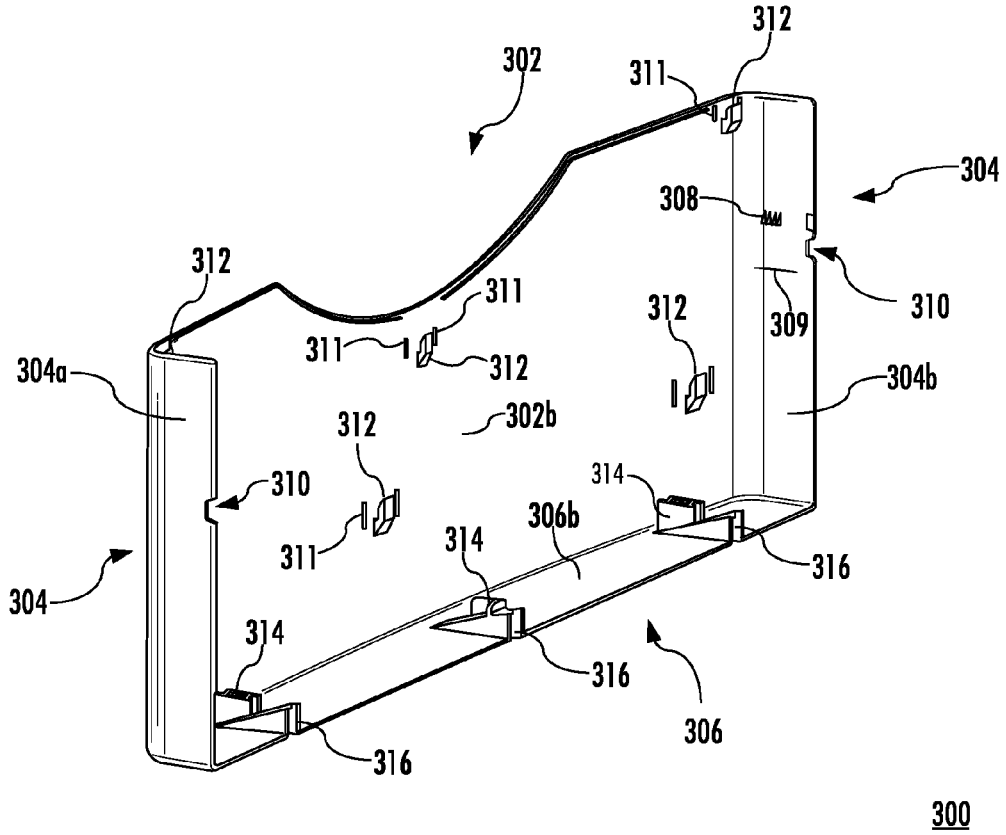
FIG. 3 is a perspective view of a kick panel of a household appliance according to an exemplary embodiment of the invention.

With reference to FIG. 3, an exemplary embodiment of a kick panel 300 will now be described. The kick panel 300 can include a front wall 302, sidewalls 304 at each end of the front wall 302, and a bottom wall 306 adjoining the lower edge of the front wall 302 and the lower edges of the side walls 304. The front wall 302 has an outer surface 302*a* (identified in FIGS. 1 and 2), which is visible to the user from the front of the appliance, and an inner surface 302*b*, which is not visible to the user. Similarly, the sidewalls 304 have an outer surface 304*a* and an inner surface 304*b*, which is adjacent to the appliance. The bottom wall 306 has an outer surface (not shown in FIG. 3) and an inner surface 306*b*.

The kick panel 300 can include one or more catch means formed on the inner surface 304*b* of the sidewall 304. The catch 308 is concealed from view from the front of the household appliance. The catch means can include, for example, a catch 308, such as a wedge-shaped catch, a snap catch, a projection, a hook, a tab, or the like that can engage the cut-out portion 208 in the front panel 200 when the kick panel 300 is snapped over the front panel 200 and that can be disengaged from the cut-out portion 208 by flexing, bowing, or bending the sidewalls 304 of the kick panel 300 away from the sidewalls 204 of the front panel 200.

In an exemplary embodiment, the kick panel 300 can include a concealed catch 308 at only a single end of the kick panel 300. In a preferred exemplary embodiment, the kick panel 300 can include at least one concealed catch 308 at each end of the kick panel 300. The arrangement and number of concealed catches 308 is not limited to the illustrated embodiments, and other arrangements and number of catches are contemplated. The catch 308 preferably can be formed from plastic. However, other materials are contemplated, such as metal. The catch 308 can be integrally formed with the kick panel, or separately formed and coupled to the kick panel 300 by conventional attachment means.

The kick panel 300, or at least the sidewalls 304 thereof, can be flexible such that the sidewalls 304 of the kick panel 300 can be flexed, bent, or bowed. The kick panel 300 can be formed, for example, from sheet metal, plastic resin, or other suitable materials with sufficient flexible characteristics. The front wall 302 of the kick panel 300 can be a planar surface or a curved surface that conforms with or corresponds to the shape of the front panel 200 of the household appliance. The top, side, and bottom edges of the kick panel 300 can have a linear shape or a curved shaped depending on the shape of the household appliance.

With reference again to FIG. 3, an exemplary embodiment of the kick panel 300 can include one or more side ribs 309 projecting from the inner surface 304*b* of the sidewall 304 and toward the sidewall 204 of the front panel 200. The one or more ribs 309 can abut against the first sidewall of the front panel to define an inside width of the kick panel 300. One or more ribs 309 can be located, for example, on each sidewall 304, and preferably, adjacent to the catch 308. The horizontal (e.g., left to right) location and fixation of the kick panel 300 can be achieved by the kick panel 300 having the same or substantially similar inside width between the ribs 309 as the outer width of the front panel 200 over which the kick panel 300 is wrapped or snapped around.

With reference again to FIG. 3, an exemplary embodiment of the kick panel 300 can include a cut-out or kick panel release hole 310 formed in an edge of the sidewall 304 of the kick panel 300, for example, corresponding to an optimal location for insertion of a screwdriver or custom tool between the sidewall 304 of the kick panel 300 and the sidewall 204 of the front panel 200, as will be described in greater detail below. The cut-out or kick panel release hole 310 can be, for example, a U-shaped cut-out on one or both side walls 304 of the kick panel 300.

In another exemplary embodiment, the inner surface 302*b* of the front wall 302 of the kick panel 300 can include a plurality of hooks 312 that engage into a plurality of corresponding cut-outs 212 formed in the front wall 202 of the front panel 200. The inner surface 302*b* of the front wall 302 of the kick panel 300 can include one or more front ribs 311 projecting away from the inner concealed surface and toward the front wall 202 of the front panel 200. The ribs 311 abut the front wall of the front panel when the plurality of hooks 312 of the kick panel are engaged with the plurality of cut-outs of the front panel. These features will be described in greater detail with reference to FIGS. 8A-9B.

Another exemplary embodiment of the kick panel 300 can include one or more stops 314 on the inner surface 306*b* of the bottom wall 306 of the kick panel 300. The stops 314 will be described in greater detail with respect to FIGS. 12A-12C. In addition to, or as an alternative to, the catches 308, other exemplary embodiments of the kick panel 300 can include one or more angled channels 316 for securing the kick panel 300 to the front panel 200 using threaded fasteners, such as screws, etc. The angled channels 316 will be described in greater detail with respect to FIGS. 13A and 13B.

Figures 4A, 4B:
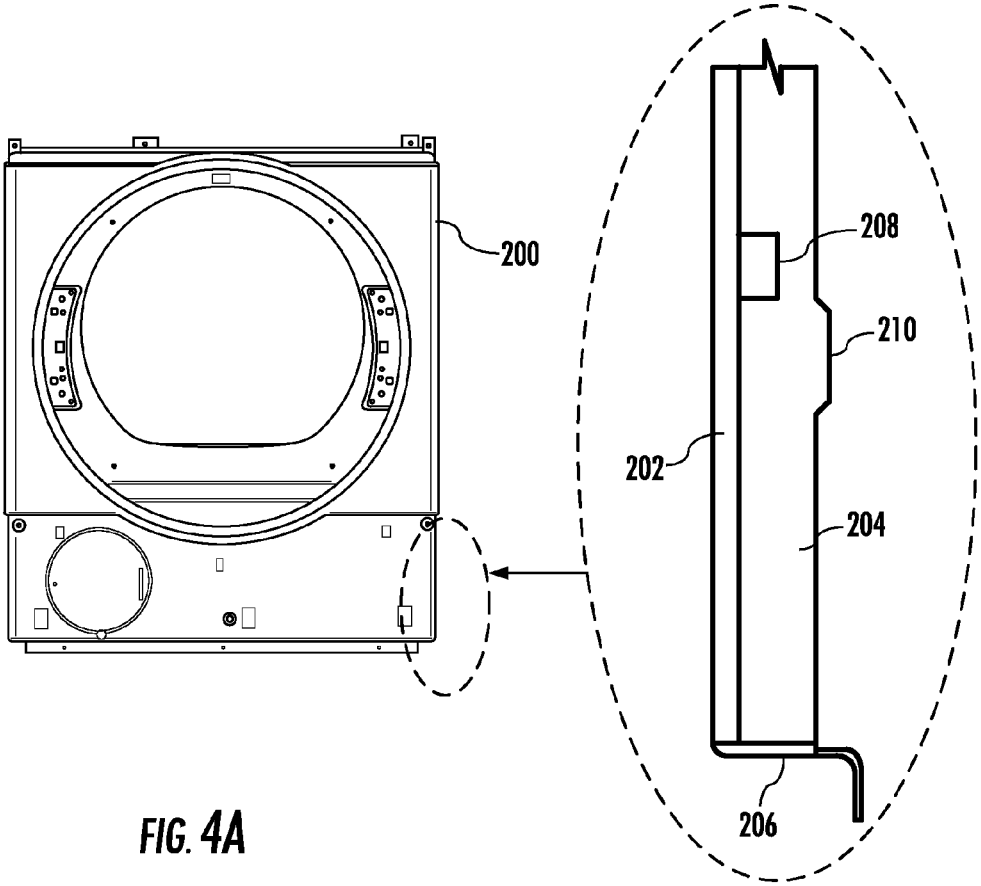
FIG. 4A is a front elevation view of a front panel of a household appliance according to an exemplary embodiment of the invention.
FIG. 4B is a partial side view of a front panel of a household appliance according to an exemplary embodiment of the invention.

With reference to FIGS. 4A and 4B, an exemplary embodiment of a front panel 200 will now be described. The front panel 200 includes a front wall 202, sidewalls 204, and bottom wall 206. The sidewalls 204 can include one or more cut-outs or retaining slots 208. The sidewalls 204 also can include a pad 210 extending from an edge of the sidewall 204 of the front panel 200. The pad 210 will be described in greater detail below with respect to FIGS. 7A and 7B.

Figure 5A:
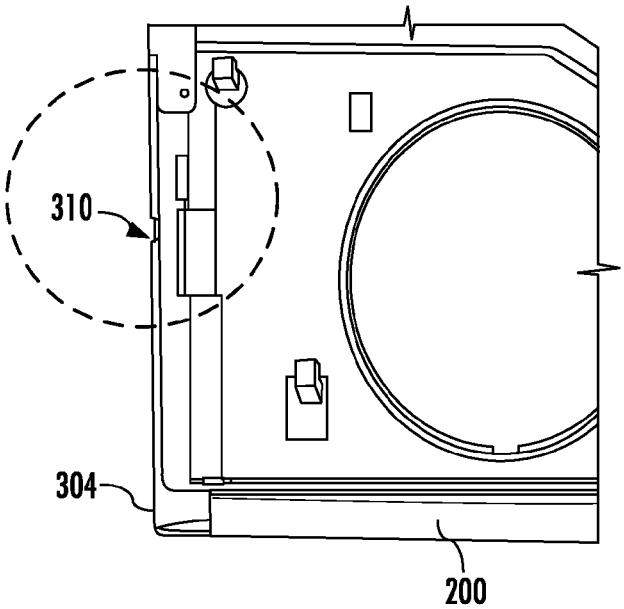
FIG. 5A is partial, rear view of an assembled kick panel and front panel of a household appliance according to an exemplary embodiment of the invention.
Figure 5B:
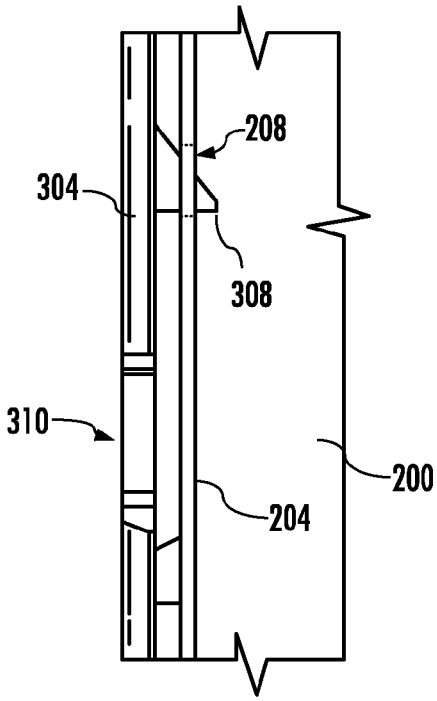
FIG. 5B is an enlarged partial, rear view of the assembled kick panel and front panel of FIG. 5A.

With reference to FIGS. 5A and 5B, an exemplary embodiment of an assembled front panel 200 and kick panel 300 will now be described. The concealed catch 308 formed on the inner surface 304*b* of the sidewall 304 of the kick panel 300 is aligned with and engages the cut-out portion or retaining slot 208 formed in the sidewall 204 of the metal front panel 200 to secure the kick panel 300 thereto. In the illustrated embodiment, the catch 308 has a wedge shape having a cam surface projecting from the inner surface 304*b* of the sidewall 304 for engaging the cut-out portion 208 formed in the sidewall 204 of the underlying metal front panel 200. The catch 308 is not limited to a wedge shape and can include other suitable shapes, such as a projection, hook, tab, or the like that can engage the cut-out portion 208 in the front panel 200 when the kick panel 300 is snapped over the front panel 200 and that can be disengaged from the cut-out portion 208 by flexing, bowing, or bending the sidewalls 304 of the kick panel 300 away from the sidewalls 204 of the front panel 200.

One of ordinary skill in the art will recognize that other embodiments can be provided within the spirit and scope of the invention. For example, in other embodiments, the catch can be formed on the outer surface of the side wall 204 of the front panel 200 for engaging a cut-out formed in the sidewall 304 of the kick panel 300.

An exemplary method for installing the kick panel will now be described with reference again to FIGS. 5A and 5B.

In operation, the kick panel 300 can be installed by aligning the kick panel 300 with the front panel 200 and then pushing the kick panel 300 against the front panel 200 (i.e., toward the household appliance). At this point, the side walls 304 of the kick panel 300 can flex or bow in an outward direction from the sidewalls 204 of the front panel 200, for example, as a result of the cam surfaces of the catches 308 on each side of the kick panel 300 gliding against the sidewalls 204 of the front panel 200. The kick panel 300 then can be pushed upwards until the two catches 308 (e.g., snap hook features) snap into the cut-outs 208 in the sidewalls 204 of the front panel 200. The catches 308 engage the cut-out portion 208 to locate and fixate the kick panel 300 in a vertical direction. At this time, the kick panel 300 can be snapped into place leaving a uniformly narrow gap between the kick panel 300 and the front panel 200 and the sidewall 400 of the appliance.

The kick panel 300 can have the same or substantially similar inside width as a width of the front panel 200 over which the kick panel 300 is wrapped or snapped around, thereby further locating and fixating the kick panel 300 in a horizontal (e.g., left to right) direction. In an exemplary embodiment, the side ribs 309 on the inner surface 304*b* can define a predetermined inside width of the kick panel 300. The horizontal (e.g., left to right) location and fixation of the kick panel 300 can be achieved by the kick panel 300 having the same or substantially similar inside width between the ribs 309 as the outer width of the front panel 200 over which the kick panel 300 is wrapped or snapped around.

One of ordinary skill in the art will recognize that the size, shape, and orientation of the catches 308 and/or side ribs 309 can vary within the spirit and scope of the invention depending on overall appliance design.

Figure 6A:
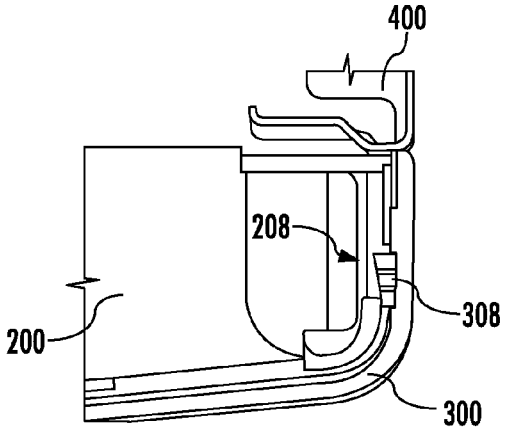
FIG. 6A is a partial, top cross-sectional view of an assembled kick panel and front panel of a household appliance according to an exemplary embodiment of the invention.
Figure 6B:
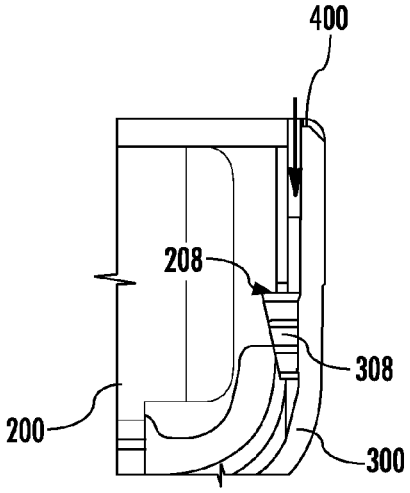
FIG. 6B is a partial, top cross-sectional view of the assembled kick panel and front panel of FIG. 6A showing a method step for removing the kick panel.
Figure 6C:
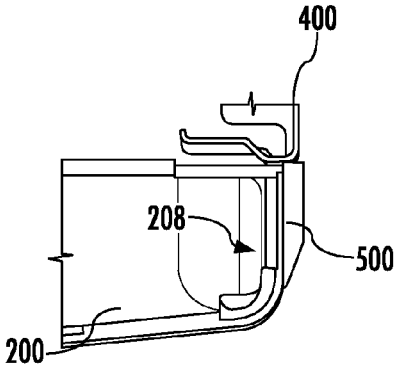
FIG. 6C is a partial, top cross-sectional view of the front panel and a wedge tool according to an exemplary embodiment of the invention.
Figure 6D:
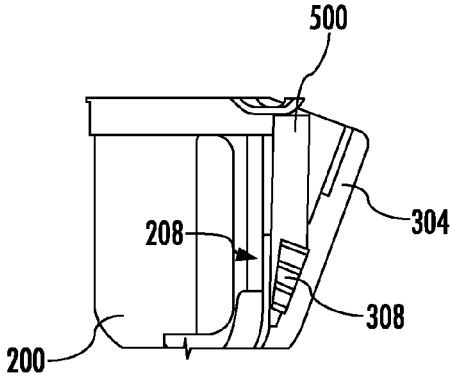
FIG. 6D is a partial, top cross-sectional view of the kick panel, front panel and wedge tool showing a method step for removing the kick panel, according to an exemplary embodiment of the invention.
Figure 6E:
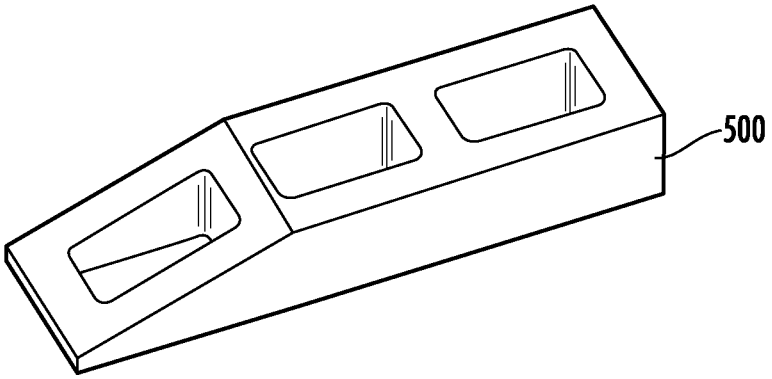
FIG. 6E is a perspective view of a wedge tool according to an exemplary embodiment of the invention.
Figure 6F:
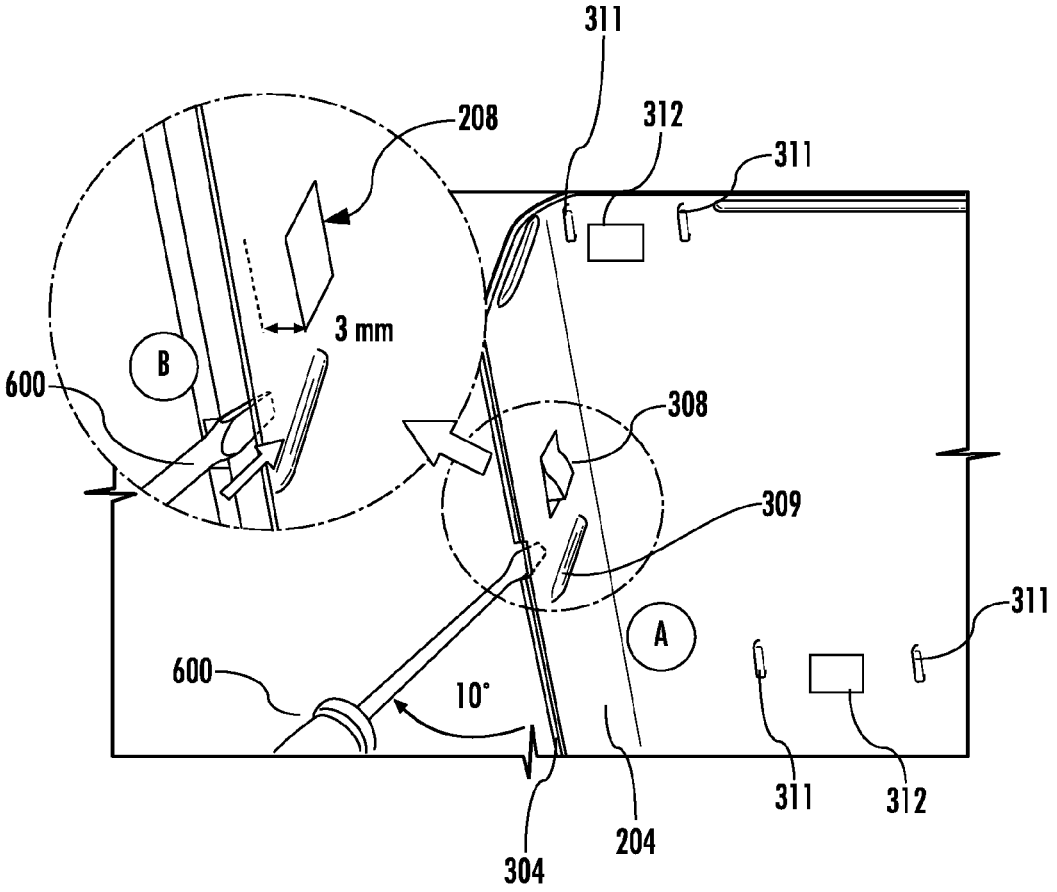
FIG. 6F is a perspective view of a method step for removing the kick panel from the front panel using a screwdriver, according to an exemplary embodiment of the invention.

With reference to FIGS. 6A-6F, an exemplary method of disengaging and removing the kick panel 300 from the front panel 200 will now be described. FIGS. 6A-6D show a top down view of the kick panel 300 and front panel 200. FIG. 6E illustrates an exemplary embodiment of a custom tool 500 for use with the present invention. FIG. 6F shows an exemplary method of removing the kick panel 300 from the front panel 200 using a screw driver.

To remove the kick panel 300, a screw driver or a custom tool (e.g., 500) can be wedged between the sidewall 304 of the kick panel 300 and the sidewall 204 of the front panel 200 in a direction shown by the arrow in FIG. 6B. The screw driver or a custom tool (e.g., 500) to flex or bow the sidewall 304 of the kick panel 300 away from the front panel 200 until the catch 308 clears the underlying cut-out portion 208 of the front panel 200. The kick panel 300 then can be removed easily and effortlessly from the front panel 200.

In another exemplary embodiment, as described with reference to FIG. 3, the kick panel 300 can include a cut-out or kick panel release hole 310 formed in an edge of the sidewall 304 of the kick panel 300, for example, corresponding to an optimal location for insertion of a screwdriver or custom tool between the sidewall 304 of the kick panel 300 and the sidewall 204 of the front panel 200, as will be described in greater detail below. The cut-out or kick panel release hole 310 can be, for example, a U-shaped cut-out on one or both side walls 304 of the kick panel 300.

In this embodiment, to remove the kick panel 300, a screw driver or a custom tool (e.g., 500) can be inserted into the cut-out 310 and between the sidewall 304 and sidewall 204 to flex or bow the sidewall 304 of the kick panel 300 away from the front panel 200 until the catch 308 clears the underlying cut-out portion 208 of the front panel 200. The kick panel 300 then can be removed easily and effortlessly from the front panel 200.

With reference to FIG. 6E, a custom wedge tool 500 according to an exemplary embodiment of the invention will now be described, In another preferred exemplary embodiment, a custom wedge tool 500 can be provided for insertion between the sidewall 304 of the kick panel 300 and the sidewall 204 of the front panel 200 to remove the kick panel 300. The custom wedge tool 500 can include a plastic wedge tool having predetermined geometric dimensions that match the design of the appliance and provide a predetermined or optimal amount of flex or bowing of the sidewall of the kick panel 300 to release the catches 308 from the cut-outs or retaining slots 208 of the front panel 200. As shown in FIGS. 6C and 6D, another exemplary embodiment can include a step formed between the sidewall 304 of the front panel 300 and the sidewall 204 of the kick panel 300 such that the exemplary plastic wedge tool 500 can snap into place when inserted there between. The wedge tool 500 can have a predetermined height that is designed to securely disengage the catch 308 when the wedge tool 500 is fully seated or snapped in place.

FIG. 6F shows an exemplary method of removing the kick panel 300 from the front panel 200 using a screw driver. The user locates the kick panel release holes 310 at each end of the kick panel 300. The flat blade of the screwdriver 600 then can be inserted into the kick panel release hole 310. The user brings the handle of the screwdriver close to the side 400 of the appliance until the screwdriver 600 is at approximately a 10 degree angle from the side 400 of the appliance. The user then can push the tip of the screwdriver 600 in between the kick panel 300 and the front panel 200. The screwdriver preferably is inserted far enough to wedge the side wall 304 of the kick panel 300 outward by about 3 to 6 mm (⅛ to ¼ inch) to free the plastic catch 308 from the retaining slot 208. The user then presses in and down on the front wall 302 of the kick panel 300 with the palm of the user's hand while wedging the sidewall 304 of the kick panel 300 outward with the screwdriver 600. The user applies light pressure to the kick panel 300 to drop the kick panel 300 down and disengage the catches 308 from the cut-outs 208 of the front panel 200.

With reference to FIGS. 8A-9B, in an exemplary embodiment, the inner surface 302*b* of the front wall 302 of the kick panel 300 can include a plurality of hooks 312 that engage into a plurality of corresponding cut-outs 212 formed in the front wall 202 of the front panel 200. The engagement of the plurality of hooks 312 into the front cut-outs 212 can secure or pull the kick panel 300 flush against the front wall 202 of the front panel 200, thereby minimizing or eliminating any rattling between the kick panel 300 and the front panel 200 during operating cycles of the household appliance.

The hooks 312 can be integrally formed with the kick panel 300, for example in the case of a plastic resin kick panel, or formed separately from the kick panel 300 and secured to the kick panel, for example, using an adhesive, welding, or other suitable means for securing the hooks to the kick panel 300. The hooks 312 can be formed from plastic, metal, or other suitable materials.

In a preferred embodiment, the inner surface 302*b* of the front wall 302 of the kick panel 300 can include six (6) hooks 312 that engage into six (6) corresponding cut-outs 212 formed in the front wall 202 of the front panel 200. For example, three hooks can be positioned near the upper edge of the kick panel and three hooks can be positioned near the lower edge of the kick panel. Other arrangements of the hooks 312 also are possible.

Figure 8A:
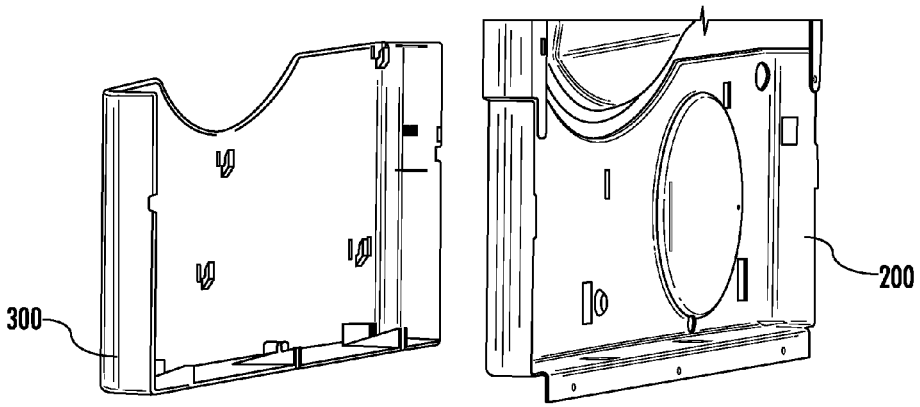
FIG. 8A is an exploded, partial assembly view of a kick panel and front panel according to an exemplary embodiment of the invention.
Figure 8B:
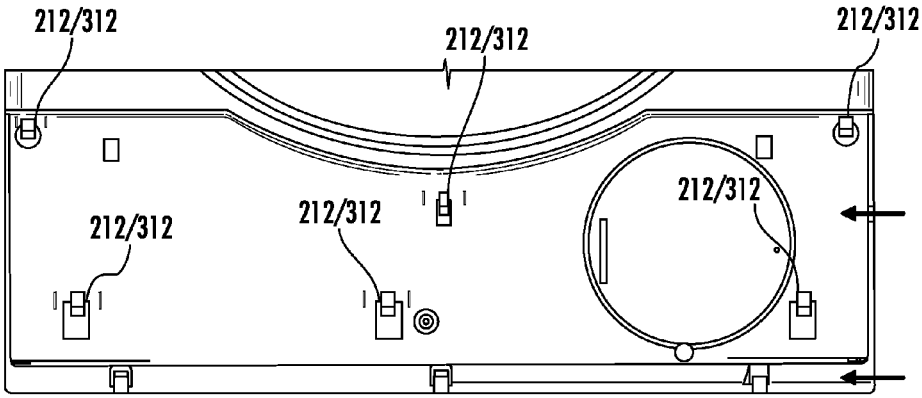
FIG. 8B is a rear view of an assembled kick panel and front panel according to an exemplary embodiment of the invention.
Figure 8C:
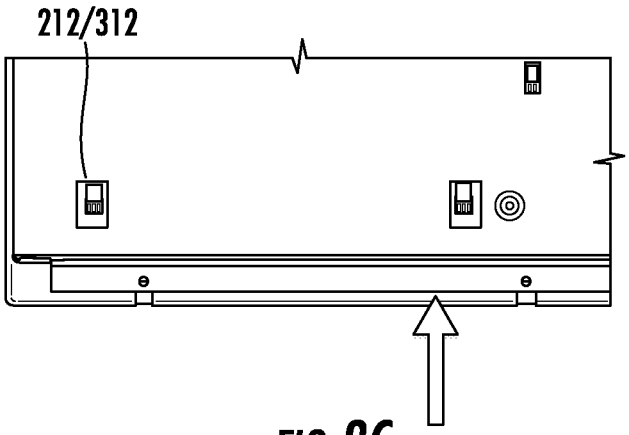
FIG. 8C is a partial rear view of a partially assembled kick panel and front panel according to an exemplary embodiment of the invention.
Figure 8D:
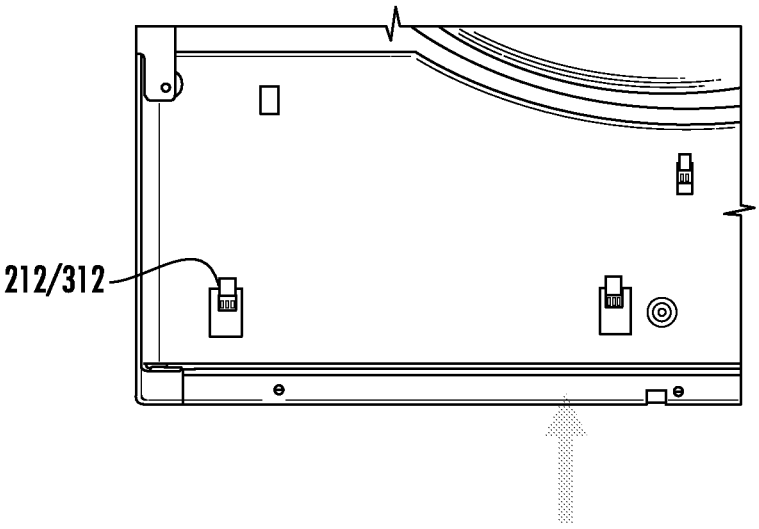
FIG. 8D is an enlarged, partial rear view of an assembled kick panel and front panel according to an exemplary embodiment of the invention.

In another exemplary embodiment, the inner surface 302*b* of the front wall 302 of the kick panel 300 can include one or more front ribs 311 projecting away from the inner concealed surface 302*b* and toward the front wall 202 of the front panel 200. The ribs 311 abut the front wall 202 of the front panel 200 when the plurality of hooks 312 of the kick panel 300 are engaged with the plurality of cut-outs 212 of the front panel 200. In a preferred exemplary embodiment, the inner surface 302*b* of the front wall 302 of the kick panel 300 can include at least one front rib 311 adjacent to each of the hooks 312, and more preferably, a pair of front ribs 311 adjacent to each of the hooks 312. For example, a rib 311 can be located on each side of the hook 312, as shown in FIGS. 3, 8A, and 8B.

With reference again to FIGS. 8A-9B, an exemplary method for installing a kick panel 300 having the front hooks 312 will now be described.

Figure 9A:
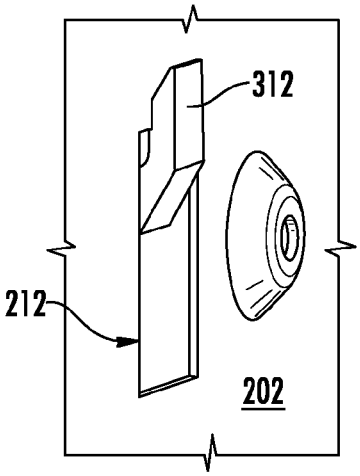
FIG. 9A is partial, perspective view of a rear hook of a kick panel engaging an opening in the front panel according to an exemplary embodiment of the invention.
Figure 9B:
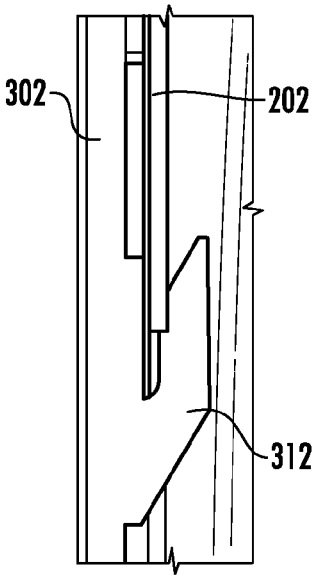
FIG. 9B is partial, cross-sectional view of the rear hook of the kick panel and the front panel of FIG. 9A.

In this embodiment, the kick panel 300 can be installed by aligning the front hooks 312 with the corresponding cut-outs 212 in the front panel 200 and then pushing the kick panel 300 against the front panel 200 (i.e. toward the household appliance). At this point, the side walls 304 of the kick panel 300 can flex or bow in an outward direction from the sidewalls 204 of the front panel 200, for example, as a result of the cam surfaces of the catches 308 on each side of the kick panel 300 gliding against the sidewalls 204 of the front panel 200. The kick panel 300 then can be pushed upwards until the front hooks 312 engage the front cut-outs 212 in the front panel 200 (as shown in FIG. 9B) and the two catches 308 (e.g., snap hook features) snap into the cut-outs 208 in the sidewalls 204 of the front panel 200. One of ordinary skill in the art will recognize that the size, shape, and orientation of the catches 308 and front hooks 312 can vary within the spirit and scope of the invention depending on overall appliance design.

Figure 7A:
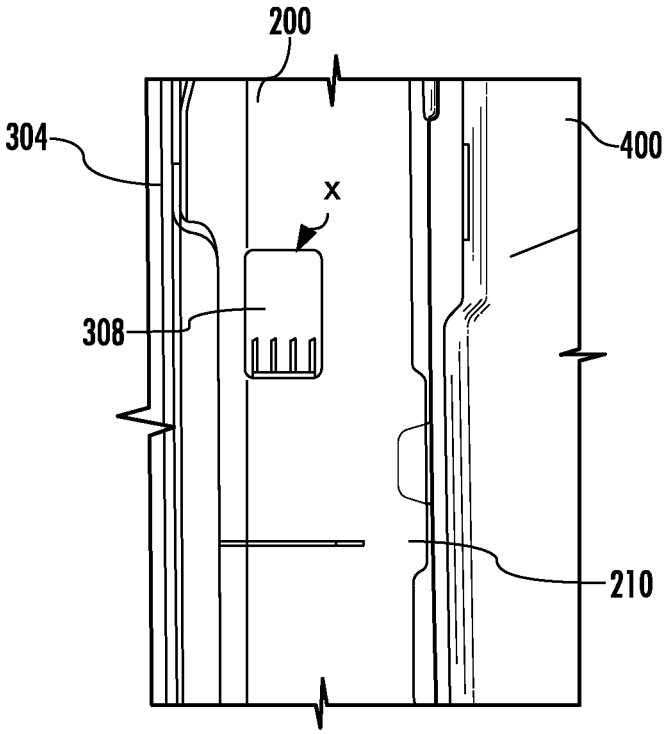
FIG. 7A is a partial, side view of an assembled kick panel, front panel, and a side panel of a household appliance according to an exemplary embodiment of the invention.
Figure 7B:
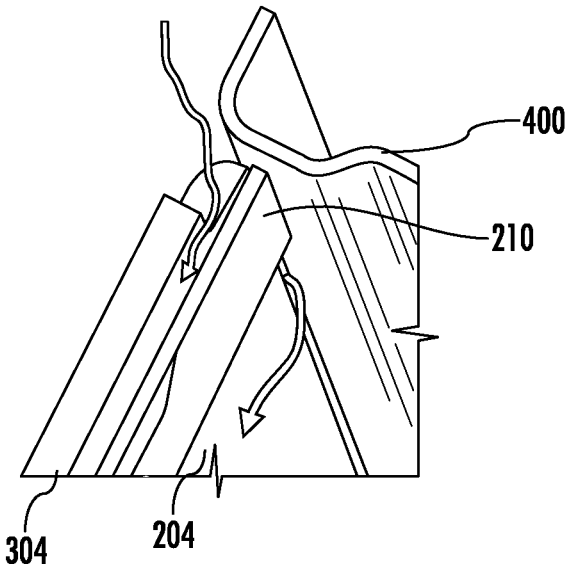
FIG. 7B is a partial, cross-sectional perspective view of an assembled kick panel, front panel, and side panel of a household appliance according to an exemplary embodiment of the invention.

With reference to FIGS. 7A and 7B, another exemplary embodiment includes a front panel 200 having one or more pads 210 for deflecting and guiding the insertion of the screwdriver into the space between the sidewall 304 of the kick panel 300 and the sidewall 204 of the front panel 200, thereby preventing the screwdriver from entering the area behind the front panel 200. The inner surface 304*a* of the sidewalls 304 of the kick panel 300 also can include pads or guides, such as a raised portion, that assists with deflecting and guiding the screwdriver into the correct position between the sidewall 304 of the kick panel 300 and the sidewall 204 of the front panel 200.

Figure 10:
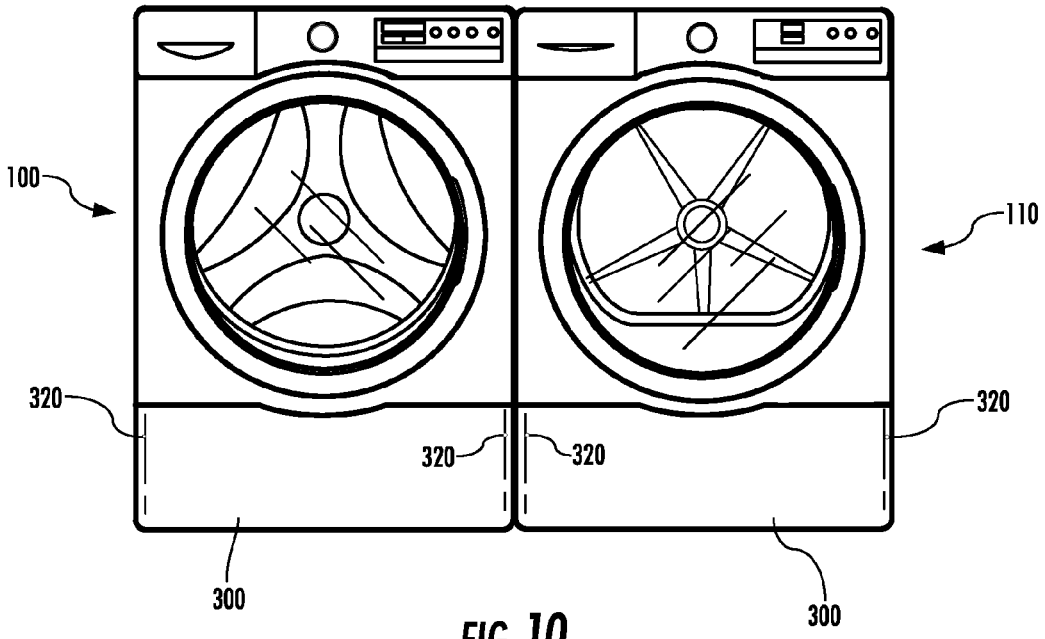
FIG. 10 is a front view of a side-by-side configuration of a washer and dryer having a kick panel according to an exemplary embodiment of the invention.
Figure 11A:
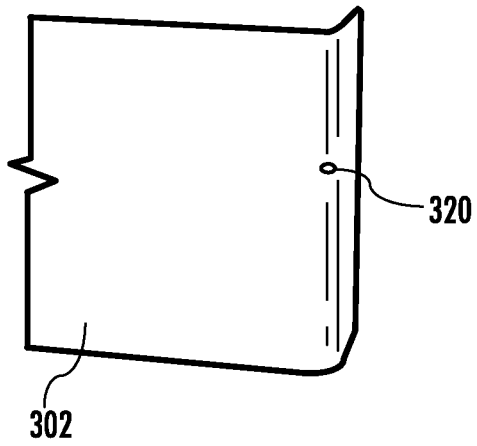
FIG. 11A is a partial, perspective view of a kick panel of a household appliance according to an exemplary embodiment of the invention.
Figure 11B:
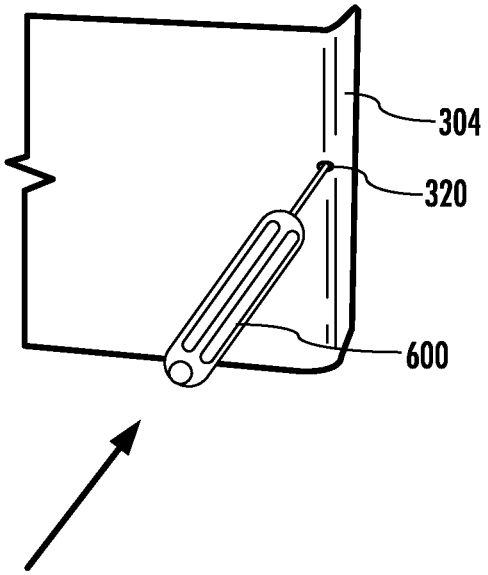
FIG. 11B is a partial, perspective view of the kick panel of a household appliance showing a method step for removing the kick panel from the front panel of the household appliance, according to an exemplary embodiment of the invention.

With reference to FIGS. 10, 11A, and 11B, another exemplary embodiment of a kick panel 300 will now be described.

The kick panel 300 can include an access hole 320 formed in the front of the kick panel 300 at each end through which a screw driver 600 or similar tool can be inserted to act as a wedge between the sidewall 304 of the kick panel 300 and the sidewall 202 of the front panel 200. In this embodiment, the screw driver 600 or similar tool can be inserted from the front of the appliance, thereby enabling the kick panel 300 to be removed from the front when access to the sidewalls 304 of the kick panel 300 is limited or unavailable, such as in a side-by-side configuration shown in FIG. 10, or in a built-in configuration in which the appliance is adjacent to walls, cabinets, etc. The access hole 320 can be circular, oval, or another shape that is suitable for receiving a screw driver (e.g., flat-head, Phillips head), hexagonal wrench, or another tool.

In operation, to remove the kick panel 300, a screw driver 600, preferably a flat-head screwdriver, can be inserted into the access hole of the kick panel and wedged between the sidewall 304 of the kick panel 300 and the sidewall 204 of the front panel 200 in a direction shown by the arrow in FIG. 11B. The screw driver 600 acts as a wedge to flex or bow the sidewall 304 of the kick panel 300 away from the front panel 200 until the catch 308 clears the underlying cut-out portion 208 of the front panel 200. The kick panel 300 then can be removed easily and effortlessly from the front panel 200. At this point, the user can apply a slight downwards force to the kick panel 300, thereby resulting in disengagement of the front hooks (if equipped) from the cut-outs in the front wall of the front panel and the kick panel 300 can be removed from the front panel 200.

Figure 12A:
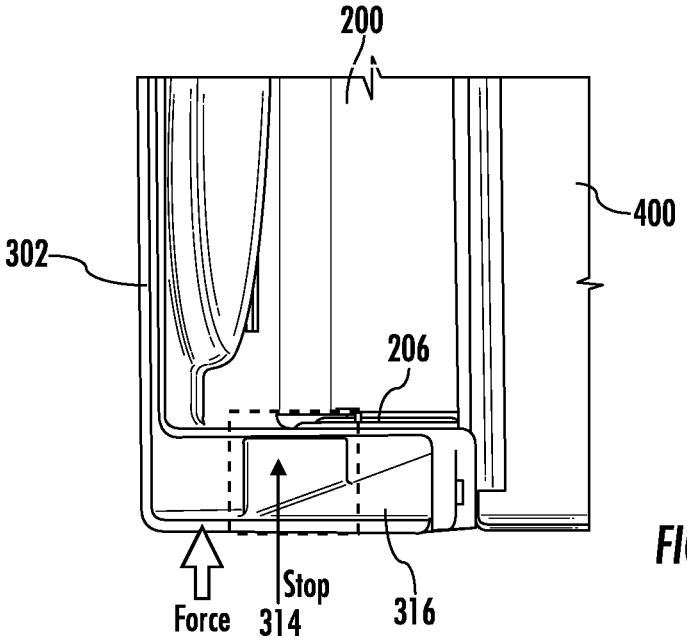
FIG. 12A is a partial, cross-sectional side view of an assembled kick panel, front panel, and side panel of a household appliance according to an exemplary embodiment of the invention.
Figure 12B:
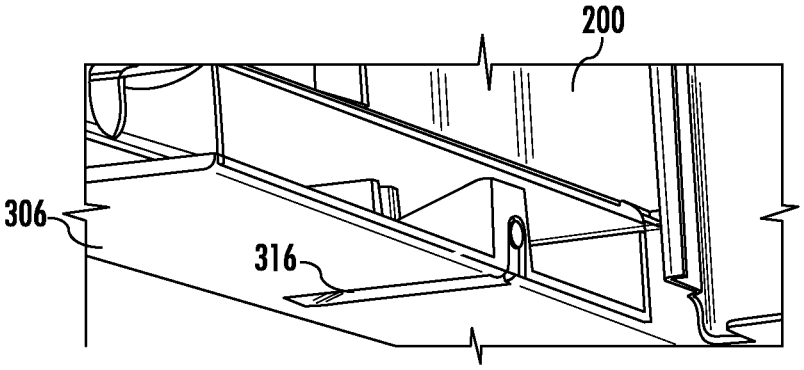
FIG. 12B is a partial, cross-sectional perspective view of an assembled kick panel, front panel, and side panel of a household appliance according to an exemplary embodiment of the invention.
Figure 12C:
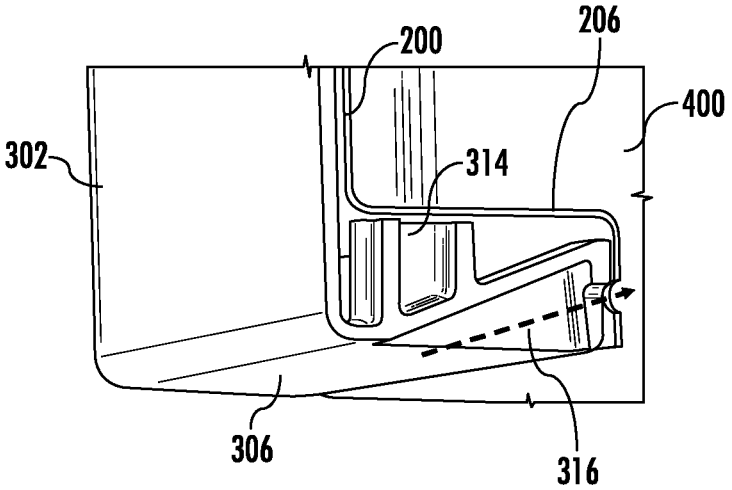
FIG. 12C is a partial, cross-sectional perspective view of an assembled kick panel, front panel, and side panel of a household appliance according to an exemplary embodiment of the invention.
Figure 13A:
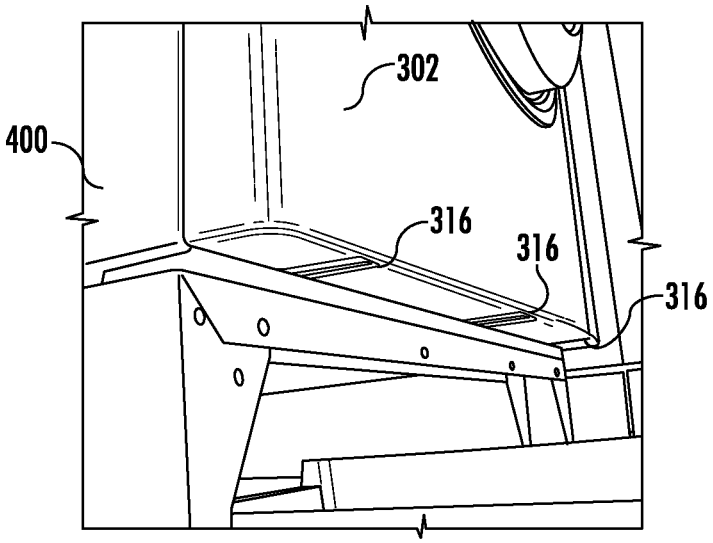
FIG. 13A is a partial perspective view of a household appliance according to an exemplary embodiment of the invention.
Figure 13B:
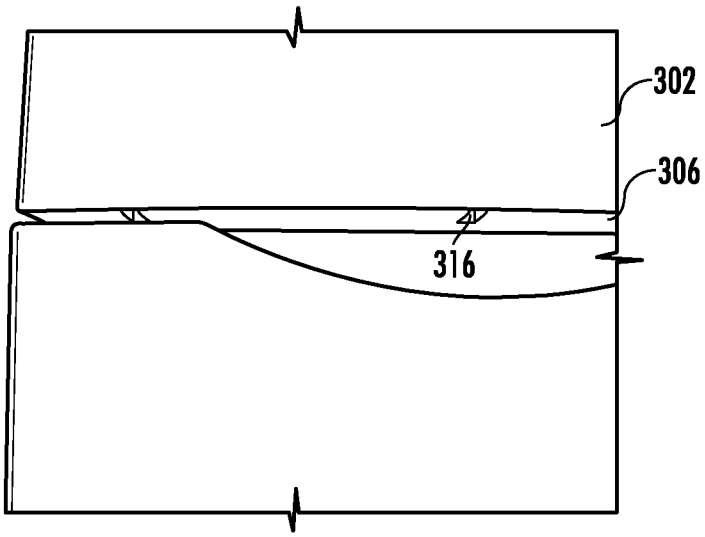
FIG. 13B is a partial perspective view of a household appliance according to an exemplary embodiment of the invention.

With reference to FIGS. 12A-12C, another exemplary embodiment of the kick panel 300 can include one or more stops 314 on the inner surface 306*b* of the bottom wall 306 of the kick panel 300. The stops 314 can be integrally formed with the kick panel 300, or separately formed and coupled to the inner surface 306*b* of the bottom wall 306 of the kick panel 300. The stops 314 can have a predetermined height that fills the void or space between the bottom wall 306 of the kick panel 300 and the bottom wall 206 of the front panel 200, thereby limiting the vertical movement of the kick panel with respect to the front panel after assembly. The stops 314 can be rigid for fixing the distance between the bottom wall 306 of the kick panel 300 and the bottom wall 206 of the front panel 200, or compressible by a predetermined amount to minimize movement between the bottom wall 306 of the kick panel 300 and the bottom wall 206 of the front panel 200 while absorbing forces applied to the bottom wall 306 of the kick panel 300.

With reference to FIGS. 12A-12C, 13A, and 13B, another exemplary embodiment of the kick panel 300 can include one or more angled channels 316 for securing the kick panel 300 to the front panel 200 using threaded fasteners, such as screws, etc. The angled channels 316 can be provided in addition to or as an alternative to the catches 308.

For example, other embodiments can include a plurality of angled channels 316 (e.g., three angled channels) formed in and spaced across the bottom wall 306 of the kick panel 300 for receiving threaded fasteners (not shown). The angled channels 316 can guide the threaded fasteners through openings in the bottom wall 306 of the kick panel 300, through openings formed in bottom wall 206 of the front panel 200, and into a bottom plate (not shown) of the appliance, thereby securing the kick panel 300 to the front panel 200. The angled channels 316 can conceal the threaded fasteners from view from the front of the appliance, while tilting the fasteners to improve access to the ends of the fasteners.

Figure 14A:
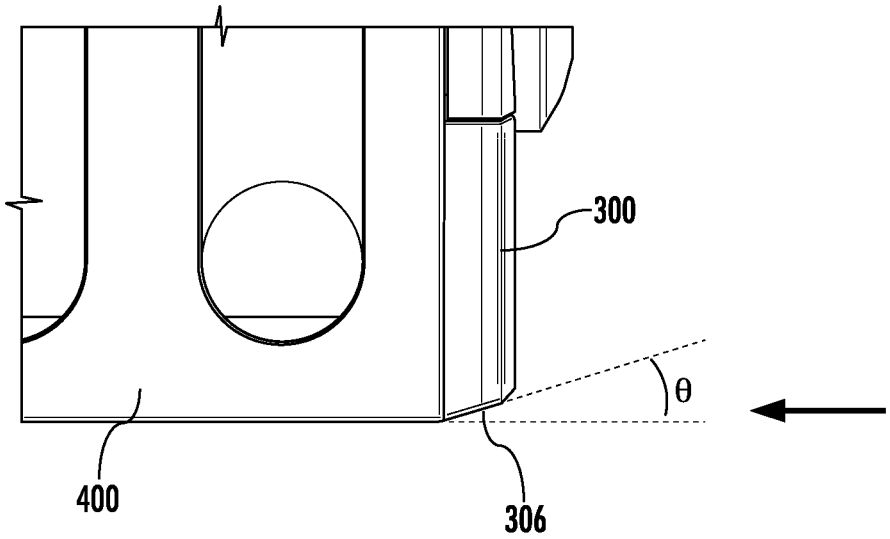
FIG. 14A is a partial side view of kick panel of a household appliance according to an exemplary embodiment of the invention.
Figure 14B:
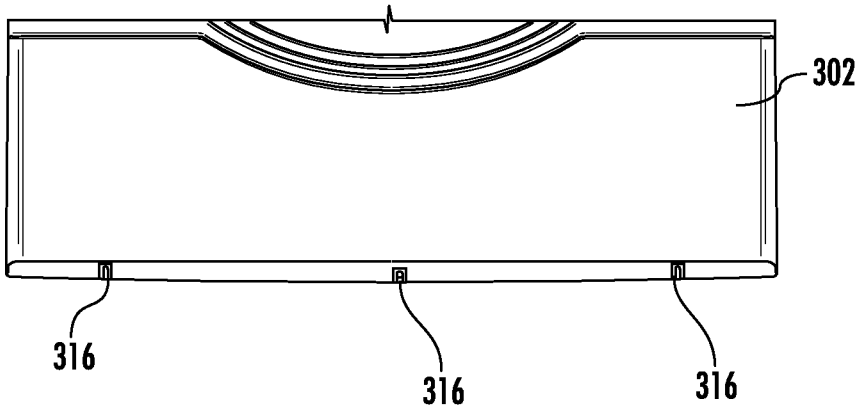
FIG. 14B is a partial front elevation view of a household appliance having a kick panel according to an exemplary embodiment of the invention.

With reference to FIGS. 14A and 14B, in another exemplary embodiment, the outer surface 306*a* of the bottom surface 306 of the kick panel 300 can be angled with respect to a bottom edge of the side walls 400 of the appliance. The angle θ can be other than 90° such that the angled channels 316 and the threaded fasteners (not shown) therein are more easily accessed by the user without moving or tilting the appliance from its resting position. Preferably, the outer surface 306*a* is angled such that the threaded fasteners (not shown) in the channel 316 can be accessed by inserting the screwdriver substantially straight into the channel 316 (e.g., in a plane perpendicular to the front of the appliance).

To summarize, the exemplary embodiments of the present invention provide a kick panel for a household appliance, such as a washer or dryer, that easily is removable from, and reinstalled on, the front panel of the household appliance by a user without secondary fixation methods (e.g., screws; clips, etc.). The kick panel according the present invention can be provided with minimal or no visible fixation areas (e.g., holes, screw heads, etc.) when the appliance is viewed from the front, thereby providing user access, for example, to the pump or other parts, while minimizing disruptions to the aesthetic appearance of the appliance.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

What is claimed is:

1. A household appliance comprising:

a housing body;

a front panel defining a front of the housing body, the front panel including a front wall and a first side wall adjacent to a first end of the front wall of the front panel, the first side wall of the front panel including a cut-out; and a kick panel removably secured to the front panel, the kick panel including a front wall and a first side wall adjacent to a first end of the front wall of the kick panel, wherein an inner concealed surface of the first side wall of the kick panel includes a catch device extending therefrom and engaging the cut-out of the front panel from an outer side of the first side wall of the front panel in a first direction extending from the inner concealed surface toward the first side wall of the front panel and securing the kick panel to the front panel, wherein the kick panel conceals the catch device from view when viewed from a front of the household appliance, wherein an edge of the first side wall of the kick panel includes one of a notch and an opening adjacent to an area of the catch device for insertion of a tool between the first sidewall of the front panel and the first sidewall of the kick panel, and wherein the catch device on the inner concealed surface of the first side wall of the kick panel is closer to the front wall of the front panel than the one of the notch and the opening such that the tool is inserted into the one of the notch and the opening in a forward direction extending from the edge of the first side wall of the kick panel toward the front wall of the front panel of the kick panel to disengage the catch device from the cut-out of the front panel in a second direction extending away from the first side wall of the front panel and toward the inner concealed surface of the first side wall of the kick panel.

2. The household appliance of claim 1, wherein the kick panel conceals the catch device from view when viewed from a side of the household appliance.

3. The household appliance of claim 1, wherein the front panel includes a bottom wall adjoining a lower edge of the front wall of the front panel and a lower edge of the first side wall of the front panel, wherein the kick panel includes a bottom wall adjoining a lower edge of the front wall of the kick panel and a lower edge of the first side wall of the kick panel, wherein an inner concealed surface of the bottom wall of the kick panel includes a plurality of stops extending upward therefrom, and wherein the plurality of stops interpose the bottom wall of the kick panel and the bottom wall of the front panel and maintain a predetermined minimum distance between the bottom wall of the kick panel and the bottom wall of the front panel.

4. The household appliance of claim 1, wherein an edge of the first side wall of the front panel includes a pad that is adjacent to an area of the catch device and that guides the tool between the first sidewall of the front panel and the first sidewall of the kick panel.

5. The household appliance of claim 1, wherein the front panel includes a second side wall adjacent to a second end of the front wall of the front panel, the second end of the front wall being opposite the first end of the front wall, wherein the kick panel includes a second side wall adjacent to a second end of the front wall of the kick panel, the second end of the kick panel being opposite the first end of the kick panel, wherein the second side wall of the front panel includes a second cut-out, and wherein an inner concealed surface of the second side wall of the kick panel includes a second catch device extending therefrom and engaging the second cut-out of the second side wall of the front panel.

6. The household appliance of claim 5, wherein an edge of the second side wall of the kick panel includes one of a notch and an opening adjacent to an area of the second catch device for insertion of a tool between the second sidewall of the front panel and the second sidewall of the kick panel, and wherein the tool disengages the second catch device from the second cut-out of the front panel.

7. The household appliance of claim 6, wherein an edge of the second side wall of the front panel includes a pad that is adjacent to an area of the second catch device and that guides the tool between the second sidewall of the front panel and the second sidewall of the kick panel.

8. The household appliance of claim 5, an opening in the front wall of the kick panel, the opening being adjacent to an area of the second catch device for insertion of a tool between the second sidewall of the front panel and the second sidewall of the kick panel, wherein the tool disengages the second catch device from the second cut-out of the front panel.

9. The household appliance of claim 1, further comprising:
an opening in the front wall of the kick panel,
the opening being adjacent to an area of the catch device for insertion of a tool between the first sidewall of the front panel and the first sidewall of the kick panel,
wherein the tool disengages the catch device from the cut-out of the front panel.

10. The household appliance of claim 1,
wherein the catch device has a wedge shape.

11. The household appliance of claim 10,
wherein a distance of an upper end of the wedge shape from the inner concealed surface of the first side wall of the kick panel is greater than a distance of a lower end of the wedge shape from the inner concealed surface of the first side wall of the kick panel.

12. The household appliance of claim 1,
wherein the kick panel is a flexible kick panel.

13. The household appliance of claim 1,
wherein the first sidewall of the kick panel is flexible.

14. The household appliance of claim 1,
wherein the household appliance is a washer.

15. The household appliance of claim 1,
wherein the household appliance is a dryer.

16. The household appliance of claim 1, wherein the inner concealed surface of the sidewall of the kick panel includes a side rib projecting toward and abutting against the first sidewall of the front panel to define an inside width of the kick panel.

17. The household appliance of claim 16, wherein the side rib is located adjacent to the catch device.

18. A household appliance comprising:
a housing body;
a front panel defining a front of the housing body, the front panel including a front wall and a first side wall adjacent to a first end of the front wall of the front panel, the first side wall of the front panel including a cut-out; and
a kick panel removably secured to the front panel, the kick panel including a front wall and a first side wall adjacent to a first end of the front wall of the kick panel,
wherein an inner concealed surface of the first side wall of the kick panel includes a catch device extending therefrom and engaging the cut-out of the front panel and securing the kick panel to the front panel,
wherein the kick panel conceals the catch device from view when viewed from a front of the household appliance,
wherein an edge of the first side wall of the kick panel includes one of a notch and an opening adjacent to an area of the catch device for insertion of a tool between the first sidewall of the front panel and the first sidewall of the kick panel,
wherein the tool disengages the catch device from the cut-out of the front panel,
wherein the front wall of the front panel includes a plurality of cut-outs,
wherein an inner concealed surface of the front wall of the kick panel includes a plurality of hooks extending therefrom in a direction toward the household appliance,
wherein each of the plurality of hooks engages one of the plurality of cut-outs of the front panel, and
wherein the kick panel conceals the plurality of hooks from view when viewed from the front of the household appliance.

19. The household appliance of claim 18,
wherein a free end of each of the plurality of hooks extends upward such that each of the plurality of hooks is inserted into the one of the plurality of cut-outs of the front panel and moved in an upward direction into a locked position with the one of the plurality of cut-outs.

20. The household appliance of claim 18, wherein the inner concealed surface of the front wall of the kick panel includes a front rib projecting toward and abutting against the front wall of the front panel when the plurality of hooks of the kick panel are engaged with the plurality of cut-outs of the front panel.

21. The household appliance of claim 18, wherein the inner concealed surface of the front wall of the kick panel includes a front rib located adjacent to each of the plurality of hooks of the front panel, the front rib projecting toward and abutting against the front wall of the front panel when the plurality of hooks of the kick panel are engaged with the plurality of cut-outs of the front panel.

22. A household appliance comprising:
a housing body;
a front panel defining a front of the housing body, the front panel including a front wall and a first side wall adjacent to a first end of the front wall of the front panel, the first side wall of the front panel including a cut-out; and
a kick panel removably secured to the front panel, the kick panel including a front wall and a first side wall adjacent to a first end of the front wall of the kick panel,
wherein an inner concealed surface of the first side wall of the kick panel includes a catch device extending therefrom and engaging the cut-out of the front panel and securing the kick panel to the front panel,
wherein the kick panel conceals the catch device from view when viewed from a front of the household appliance,
wherein an edge of the first side wall of the kick panel includes one of a notch and an opening adjacent to an area of the catch device for insertion of a tool between the first sidewall of the front panel and the first sidewall of the kick panel,
wherein the tool disengages the catch device from the cut-out of the front panel,
wherein the front panel includes a bottom wall adjoining a lower edge of the front wall of the front panel and a lower edge of the first side wall of the front panel,
wherein the kick panel includes a bottom wall adjoining a lower edge of the front wall of the kick panel and a lower edge of the first side wall of the kick panel,
wherein an inner concealed surface of the bottom wall of the kick panel includes a plurality of stops extending upward therefrom,
wherein the plurality of stops interpose the bottom wall of the kick panel and the bottom wall of the front panel and maintain a predetermined minimum distance between the bottom wall of the kick panel and the bottom wall of the front panel, and
wherein the bottom wall of the kick panel includes a plurality of angled channels for guiding a fastener through an opening in the bottom wall of the kick panel and into the bottom wall of the front panel.

23. A kick panel for a household appliance, wherein the household appliance includes a housing body and a front panel defining a front of the housing body, the front panel including a front wall and a first side wall adjacent to a first end of the front wall of the front panel, the first side wall of the front panel including a cut-out, wherein the kick panel comprises:
a front wall and a first side wall adjacent to a first end of the front wall of the kick panel,
wherein an inner concealed surface of the first side wall of the kick panel includes a catch device extending therefrom for engaging the cut-out of the front panel from an outer side of the first side wall of the front panel in a first direction extending from the inner concealed surface toward the first side wall of the front panel and securing the kick panel to the front panel, wherein the kick panel conceals the catch device from view when viewed from a front of the household appliance, wherein an edge of the first side wall of the kick panel includes one of a notch and an opening adjacent to an area of the catch device for insertion of a tool between the first sidewall of the front panel and the first sidewall of the kick panel, and wherein the catch device on the inner concealed surface of the first side wall of the kick panel is closer to the front wall of the front panel than the one of the notch and the opening such that the tool is inserted into the one of the notch and the opening in a forward direction extending from the edge of the first side wall of the kick panel toward the front wall of the front panel of the kick panel to disengage the catch device from the cut-out of the front panel in a second direction extending away from the first side wall of the front panel and toward the inner concealed surface of the first side wall of the kick panel.

24. The kick panel of claim 23, wherein the front panel includes a bottom wall adjoining a lower edge of the front wall of the front panel and a lower edge of the first side wall of the front panel, wherein the kick panel includes a bottom wall adjoining a lower edge of the front wall of the kick panel and a lower edge of the first side wall of the kick panel, wherein an inner concealed surface of the bottom wall of the kick panel includes a plurality of stops extending upward therefrom, and wherein the plurality of stops interpose the bottom wall of the kick panel and the bottom wall of the front panel and maintain a predetermined minimum distance between the bottom wall of the kick panel and the bottom wall of the front panel.

25. The kick panel of claim 23, wherein an edge of the first side wall of the front panel includes a pad that is adjacent to an area of the catch device and that guides the tool between the first sidewall of the front panel and the first sidewall of the kick panel.

26. The kick panel of claim 23, wherein the front panel includes a second side wall adjacent to a second end of the front wall of the front panel, the second end of the front wall being opposite the first end of the front wall, wherein the kick panel includes a second side wall adjacent to a second end of the front wall of the kick panel, the second end of the kick panel being opposite the first end of the kick panel, wherein the second side wall of the front panel includes a second cut-out, and wherein an inner concealed surface of the second side wall of the kick panel includes a second catch device extending therefrom and engaging the second cut-out of the second side wall of the front panel.

27. The kick panel of claim 26, wherein an edge of the second side wall of the kick panel includes one of a notch and an opening adjacent to an area of the second catch device for insertion of a tool between the second sidewall of the front panel and the second sidewall of the kick panel, and wherein the tool disengages the second catch device from the second cut-out of the front panel.

28. The kick panel of claim 27, wherein an edge of the second side wall of the front panel includes a pad that is adjacent to an area of the second catch device and that guides the tool between the second sidewall of the front panel and the second sidewall of the kick panel.

29. The kick panel of claim 26, an opening in the front wall of the kick panel, the opening being adjacent to an area of the second catch device for insertion of a tool between the second sidewall of the front panel and the second sidewall of the kick panel, wherein the tool disengages the second catch device from the second cut-out of the front panel.

30. The kick panel of claim 23, further comprising:

an opening in the front wall of the kick panel, the opening being adjacent to an area of the catch device for insertion of a tool between the first sidewall of the front panel and the first sidewall of the kick panel, wherein the tool disengages the catch device from the cut-out of the front panel.

31. The kick panel of claim 23, wherein the catch device has a wedge shape.

32. The kick panel of claim 31, wherein a distance of an upper end of the wedge shape from the inner concealed surface of the first side wall of the kick panel is greater than a distance of a lower end of the wedge shape from the inner concealed surface of the first side wall of the kick panel.

33. The kick panel of claim 23, wherein one of the kick panel is a flexible kick panel and the first sidewall of the kick panel is flexible.

34. The kick panel of claim 23, wherein the inner concealed surface of the sidewall of the kick panel includes a side rib projecting toward and abutting against the first sidewall of the front panel to define an inside width of the kick panel.

35. The kick panel of claim 34, wherein the side rib is located adjacent to the catch device.

36. A kick panel for a household appliance, wherein the household appliance includes a housing body and a front panel defining a front of the housing body, the front panel including a front wall and a first side wall adjacent to a first end of the front wall of the front panel, the first side wall of the front panel including a cut-out, wherein the kick panel comprises:

a front wall and a first side wall adjacent to a first end of the front wall of the kick panel, wherein an inner concealed surface of the first side wall of the kick panel includes a catch device extending therefrom for engaging the cut-out of the front panel and securing the kick panel to the front panel, wherein the kick panel conceals the catch device from view when viewed from a front of the household appliance, wherein an edge of the first side wall of the kick panel includes one of a notch and an opening adjacent to an area of the catch device for insertion of a tool between the first sidewall of the front panel and the first sidewall of the kick panel, wherein the tool disengages the catch device from the cut-out of the front panel, wherein the front wall of the front panel includes a plurality of cut-outs, wherein an inner concealed surface of the front wall of the kick panel includes a plurality of hooks extending therefrom in a direction toward the household appliance, wherein each of the plurality of hooks engages one of the plurality of cut-outs of the front panel, and wherein the kick panel conceals the plurality of hooks from view when viewed from the front of the household appliance.

37. The kick panel of claim 36, wherein a free end of each of the plurality of hooks extends upward such that each of the plurality of hooks is inserted into the one of the plurality of cut-outs of the front panel and moved in an upward direction into a locked position with the one of the plurality of cut-outs.

38. The kick panel of claim 36, wherein the inner concealed surface of the front wall of the kick panel includes a front rib projecting away from the inner concealed surface for abutting against the front wall of the front panel when the plurality of hooks of the kick panel are engaged with the plurality of cut-outs of the front panel.

39. The kick panel of claim 36, wherein the inner concealed surface of the front wall of the kick panel includes a front rib located adjacent to each of the plurality of hooks of the front panel, the front rib projecting away from the inner concealed surface for abutting against the front wall of the front panel when the plurality of hooks of the kick panel are engaged with the plurality of cut-outs of the front panel.

40. A kick panel for a household appliance, wherein the household appliance includes a housing body and a front panel defining a front of the housing body, the front panel including a front wall and a first side wall adjacent to a first end of the front wall of the front panel, the first side wall of the front panel including a cut-out, wherein the kick panel comprises:

a front wall and a first side wall adjacent to a first end of the front wall of the kick panel, wherein an inner concealed surface of the first side wall of the kick panel includes a catch device extending therefrom for engaging the cut-out of the front panel and securing the kick panel to the front panel, wherein the kick panel conceals the catch device from view when viewed from a front of the household appliance, wherein an edge of the first side wall of the kick panel includes one of a notch and an opening adjacent to an area of the catch device for insertion of a tool between the first sidewall of the front panel and the first sidewall of the kick panel, wherein the tool disengages the catch device from the cut-out of the front panel, wherein the front panel includes a bottom wall adjoining a lower edge of the front wall of the front panel and a lower edge of the first side wall of the front panel, wherein the kick panel includes a bottom wall adjoining a lower edge of the front wall of the kick panel and a lower edge of the first side wall of the kick panel, wherein an inner concealed surface of the bottom wall of the kick panel includes a plurality of stops extending upward therefrom, wherein the plurality of stops interpose the bottom wall of the kick panel and the bottom wall of the front panel and maintain a predetermined minimum distance between the bottom wall of the kick panel and the bottom wall of the front panel, and wherein the bottom wall of the kick panel includes a plurality of angled channels for guiding a fastener through an opening in the bottom wall of the kick panel and into the bottom wall of the front panel.

41. A household appliance comprising:

a housing body;

a front panel defining a front of the housing body, the front panel including a front wall and a first side wall adjacent to a first end of the front wall of the front panel, the first side wall of the front panel including a cut-out; and a kick panel removably secured to the front panel, the kick panel including a front wall and a first side wall adjacent to a first end of the front wall of the kick panel, wherein an inner concealed surface of the first side wall of the kick panel includes concealed catch means for engaging the cut-out of the front panel from an outer side of the first side wall of the front panel in a first direction extending from the inner concealed surface toward the first side wall of the front panel and securing the kick panel to the front panel, wherein the kick panel conceals the concealed catch means from view when viewed from a front of the household appliance, wherein an edge of the first side wall of the kick panel includes tool insertion means adjacent to an area of the concealed catch means for insertion of a tool between the first sidewall of the front panel and the first sidewall of the kick panel, and wherein the concealed catch means on the inner concealed surface of the first side wall of the kick panel is closer to the front wall of the front panel than the tool insertion means such that the tool is inserted into the tool insertion means in a forward direction extending from the edge of the first side wall of the kick panel toward the front wall of the front panel of the kick panel to disengage the concealed catch means from the cut-out of the front panel in a second direction extending away from the first side wall of the front panel and toward the inner concealed surface of the first side wall of the kick panel.

* * * * *